US006202940B1

(12) United States Patent
Kampichler

(10) Patent No.: US 6,202,940 B1
(45) Date of Patent: Mar. 20, 2001

(54) PUMP NOZZLE

(75) Inventor: Guenter Kampichler, Ruhstorf (DE)

(73) Assignee: Motorenfabrik Hatz GmbH & Co. KG, Ruhstorf (DE)

( * ) Notice: Subject to any disclaimer, the term of this patent is extended or adjusted under 35 U.S.C. 154(b) by 0 days.

(21) Appl. No.: 09/214,472

(22) PCT Filed: May 18, 1998

(86) PCT No.: PCT/EP98/02917

§ 371 Date: Jan. 21, 1999

§ 102(e) Date: Jan. 21, 1999

(87) PCT Pub. No.: WO98/53196

PCT Pub. Date: Nov. 26, 1998

(30) Foreign Application Priority Data

May 21, 1997 (DE) ..... 197 21 241

(51) Int. Cl.[7] ..... F02M 47/02

(52) U.S. Cl. ..... 239/88; 239/533.2; 239/533.9; 267/177

(58) Field of Search ..... 239/88.96, 533.2–533.12; 267/177, 175

(56) References Cited

U.S. PATENT DOCUMENTS

| | | |
|---|---|---|
| 4,650,116 | 3/1987 | Prillwitz . |
| 5,326,034 | 7/1994 | Peters . |

FOREIGN PATENT DOCUMENTS

| | | |
|---|---|---|
| 1126678 | 3/1962 | (DE) . |
| 4127003 | 2/1993 | (DE) . |
| 2226078 | 6/1990 | (GB) . |

*Primary Examiner*—Patrick Brinson
*Assistant Examiner*—Dinh Q. Nguyen
(74) *Attorney, Agent, or Firm*—Helfgott & Karas, P.C.

(57) ABSTRACT

The invention relates to a pump nozzle (1) for injecting fuel into an internal combustion engine, especially a single cylinder diesel engine, comprising a piston foot (3), a pump cylinder (8), a pump piston (7), an intermediate disk (16), and an injection nozzle with a pressure spring (14) a pressure spring plate (15) and a nozzle needle (20). The inventive pump nozzle has a reduced construction length by virtue of the pressure spring (14) being offset to the side of the nozzle needle axis.

4 Claims, 3 Drawing Sheets

PUMP NOZZLE

The invention relates to a pump nozzle for injecting fuel into an internal combustion engine, especially a one-cylinder diesel engine, which is provided with a piston foot, a pump cylinder, a pump piston, an intermediate washer and an injection nozzle with compression spring, compression-spring plate and valve needle.

Conventional injection systems comprise an injection pump, whose outlets communicate via pressure lines with a plurality of injection nozzles. The pressure lines have physical characteristics which act to limit power since, under the conditions prevailing in high-pressure injection systems, the fuel can no longer be regarded as a stiff, incompressible fluid, and the processes during injections are governed by laws similar to those of acoustics. For example, the pressure line acts as a "harmful" volume in the system, since it limits the attainable peak pressures, and the dynamics of the pressure line make it difficult to maintain control over the injection processes (after-spurts, cavitation).

Pump nozzles have already been in use for some time to avoid these disadvantages caused by the line. In such a construction, injection pump and injection nozzle constitute a unit. One pump nozzle per cylinder is mounted in the cylinder head and driven either directly via a piston foot or indirectly by the camshaft via rocker arm. Control can be exerted either via a common control rod in the cylinder head, in analogy with an in-line injection pump, or by an alternative low-pressure proportioning pump. However, directly controlled pump nozzles are already known as well. In such a construction, the overflow port, which in the case of in-line injection pumps is controlled with the inclined edge for flow regulation, is operated via a quick-acting high-pressure solenoid valve. The pump nozzle delivers as long as the solenoid valve is closed.

German Patent DE 4127003 A1 discloses an electrically controlled pump nozzle of the class in question for fuel-injection devices in internal combustion machines. The pump nozzle described therein is provided with a pump housing which contains a pump cylinder, in which there is guided a pump piston which defines a pump working chamber and is driven with constant stroke. In the extension of its centerline there is disposed a retaining element on which there is mounted a nozzle body.

This and other known pump-nozzle variants share the feature of large overall length. For this reason, the pump nozzle has been used heretofore mainly in engines with very large dimensions.

German Patent Application DE-AS 1126678 indeed proposes a pump nozzle in which a cup spring is provided as the valve compression spring in order to lessen the area of the injection housing heated by the combustion gases as well as to reduce the housing diameter. This design has the disadvantage, however, that the spring pressure is not adjustable and the use of commercial pump components to lower the costs is ruled out.

The object of the present invention is therefore to provide a pump nozzle which can be manufactured inexpensively, which has a short overall length and which thereby is suitable even for small diesel engines.

This object is achieved according to the invention by the features of claim 1.

The pump nozzle according to the invention is constructed in such a way that a pump-piston foot is connected to a pump piston, which is accommodated in a pump cylinder. An intermediate washer and a valve needle connected thereto, together with a nozzle body, form the nozzle.

Disposed off to the side of the valve-needle axis there is provided a compression spring as the valve-needle-closing spring. Hereby there is achieved a compact structure with very short overall length.

An advantageous further embodiment of the invention provides that the compression spring is disposed beside the pump cylinder. In this case the compression spring can have the form of a helical spring, whose axis runs parallel to the valve-needle axis.

Another further embodiment of the invention provides that the valve needle is subjected via a reversing lever to the spring pressure of the pre-loaded compression spring. Advantageously the reversing lever is provided with a pivot or a lever fulcrum on the intermediate washer, the valve needle and the compression-spring plate.

When opening pressure is reached, the fuel presses on the valve needle, thus lifting it and simultaneously the reversing lever. For this purpose the opening pressure must be sufficiently high that it overcomes and opposes the spring pressure exerted by the compression spring via the reversing lever on the valve needle. The further the valve needle is lifted from its seat in the nozzle, the more the compression spring is compressed. Conversely, when the closing pressure is reached, the valve needle is forced sealingly into the nozzle orifice by the compression spring acting through the reversing lever, and thus the injection nozzle is closed.

Advantageously the intermediate washer is provided with a longitudinal slot to accommodate the reversing lever. Hereby the overall length can be further shortened.

In another advantageous further embodiment of the present invention, a piston lug between piston foot and pump piston and a control sleeve are provided for mechanical regulation of the injection flow. In this case, fuel is proportioned according to the overflow principle with inclined edges, the effective stroke of the pump element being varied by turning it. Inlet ports communicating with the suction chamber of the injection pump are disposed in the pump cylinder.

The control sleeve is advantageously constructed as a profiled sheet-metal sleeve with a control connecting rod. For example, the control sleeve can comprise a polygonal profile, thus giving the piston lug adequate clearance for axial up and down movement, while also providing for turning of the pump piston and thus of the longitudinal slot via the control connecting rod, which is attached by rivet or spot weld. Hereby the need is obviated for an expensive and complex toothed control rack, which engages in a sealing toothed gear mounted on the piston.

Another advantageous embodiment provides that a solenoid valve is disposed on the upstream side for electronic injection control. Thereby injection flow and start of injection can be regulated in simple manner by one component.

Furthermore, it is advantageous for the piston foot to be connected by a driver to a driving element. By attaching the driver on the side of the driving element, such as a driving cam or rocker arm, and by the possibility of connecting the driver with the piston end by simple swiveling of the driver, there is achieved particularly simple mounting of the injection pump on the motor. Once the piston foot with its broadened foot plate has been brought into bearing position on the driving element, the driver is simply swiveled above the foot plate, so that it engages via the rear side of the foot plate and prevents it from being lifted by the driving element during operation of the engine. Hereby the expensive piston springs which are standard in conventional injection pumps can be completely replaced.

Yet another advantageous embodiment of the present invention provides that the compression-spring chamber is constructed as the fuel feed. A cost-saving, compact structure is also achieved by this multiple function.

The invention will be described hereinafter on the basis of an advantageous embodiment with reference to the attached drawings, wherein.

Figure 1:
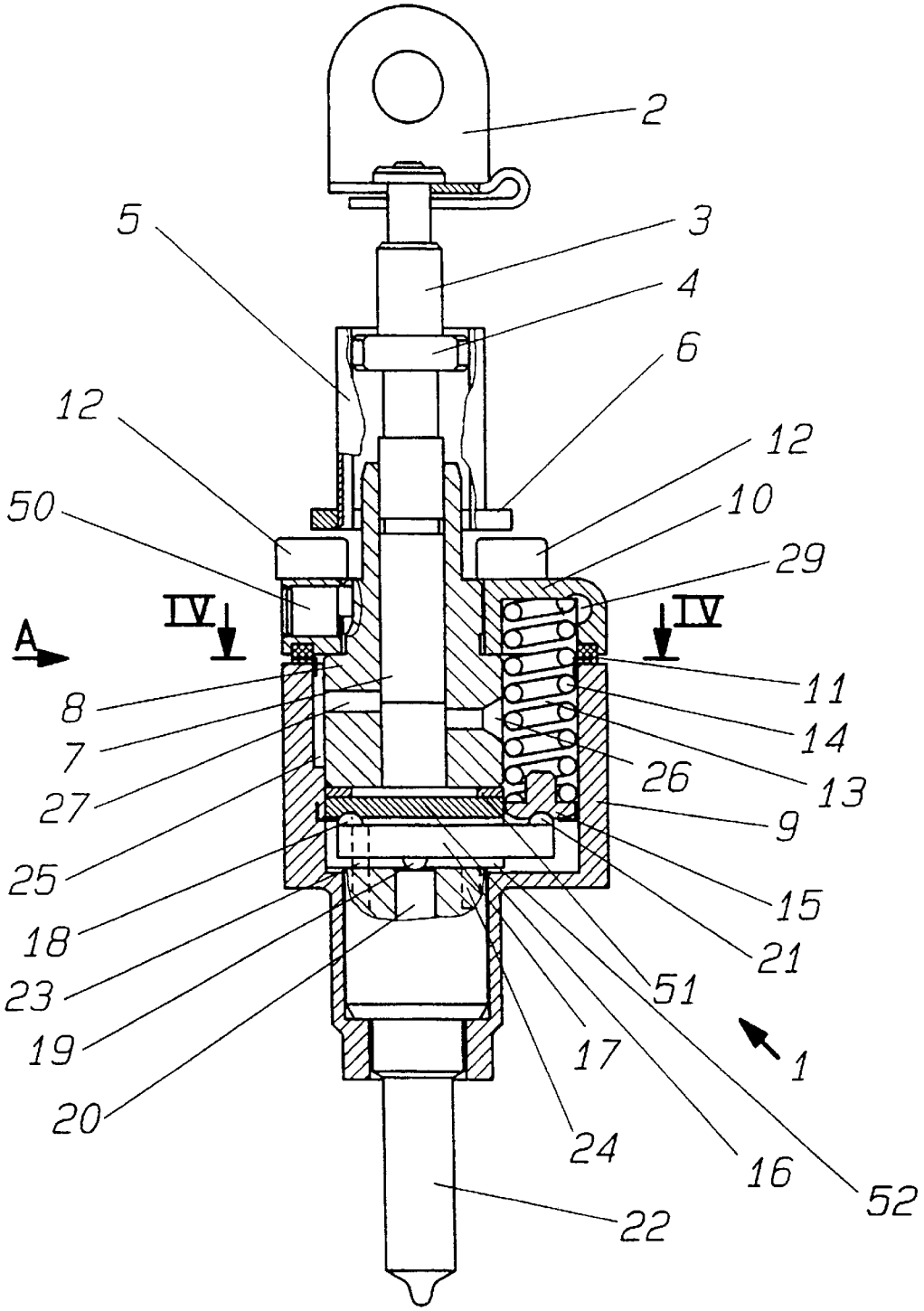
FIG. 1 shows a section through an embodiment of the pump nozzle according to the invention.

FIG. 1 shows an advantageous embodiment of the pump nozzle 1 according to the invention, with a driver 2. This is connected to a piston fool 3 of a pump piston 7 by means of a driving element, which is not shown. On piston foot 3 there is disposed a piston lug 4, which is accommodated in a profiled control sleeve 5 with a control connecting rod 6 such that it can move freely in axial direction. Pump piston 7 is disposed in a pump cylinder 8, which in turn is accommodated in a pump-nozzle housing 9. Pump-nozzle housing 9 is closed sealingly at one end by a cover 10, a packing cord 11 and screws 12. Pump-nozzle housing 9 is also provided with a compression-spring chamber 13 containing a compression spring 14 as well as a compression-spring plate 15. An intermediate washer 16, which is provided with a slot to accommodate a reversing lever 17, is attached to pump cylinder 8 and disposed in pump-nozzle housing 9. Reversing lever 17 is braced against a pivot 18 disposed on the intermediate washer 16 and serving as a fulcrum, and by means of a further pivot 19 bears on the valve needle 20. A third pivot 21 serves as a fulcrum with respect to compression-spring plate 15 of compression spring 14. Valve needle 20 is guided in the nozzle body 22. Also illustrated is the pressure duct 23, which passes through the intermediate washer into nozzle body 22. Furthermore, there is illustrated a locating pin 24, which is used for positioning intermediate washer 16 on nozzle body 22. Pump-nozzle housing 9 is provided with a hollowed-out section 25, which on the one hand opens into compression-spring chamber 13 and on the other hand communicates with the interior of pump cylinder 8 via ports 26, 27. An adjusting eccentric member 50 is used to twist the element cylinder toward pump-nozzle housing 9 and thus to achieve fine calibration of the injection flow. An 0-ring 51 provides for high-pressure sealing of pump cylinder 8 with respect to intermediate washer 16.

Figure 2:
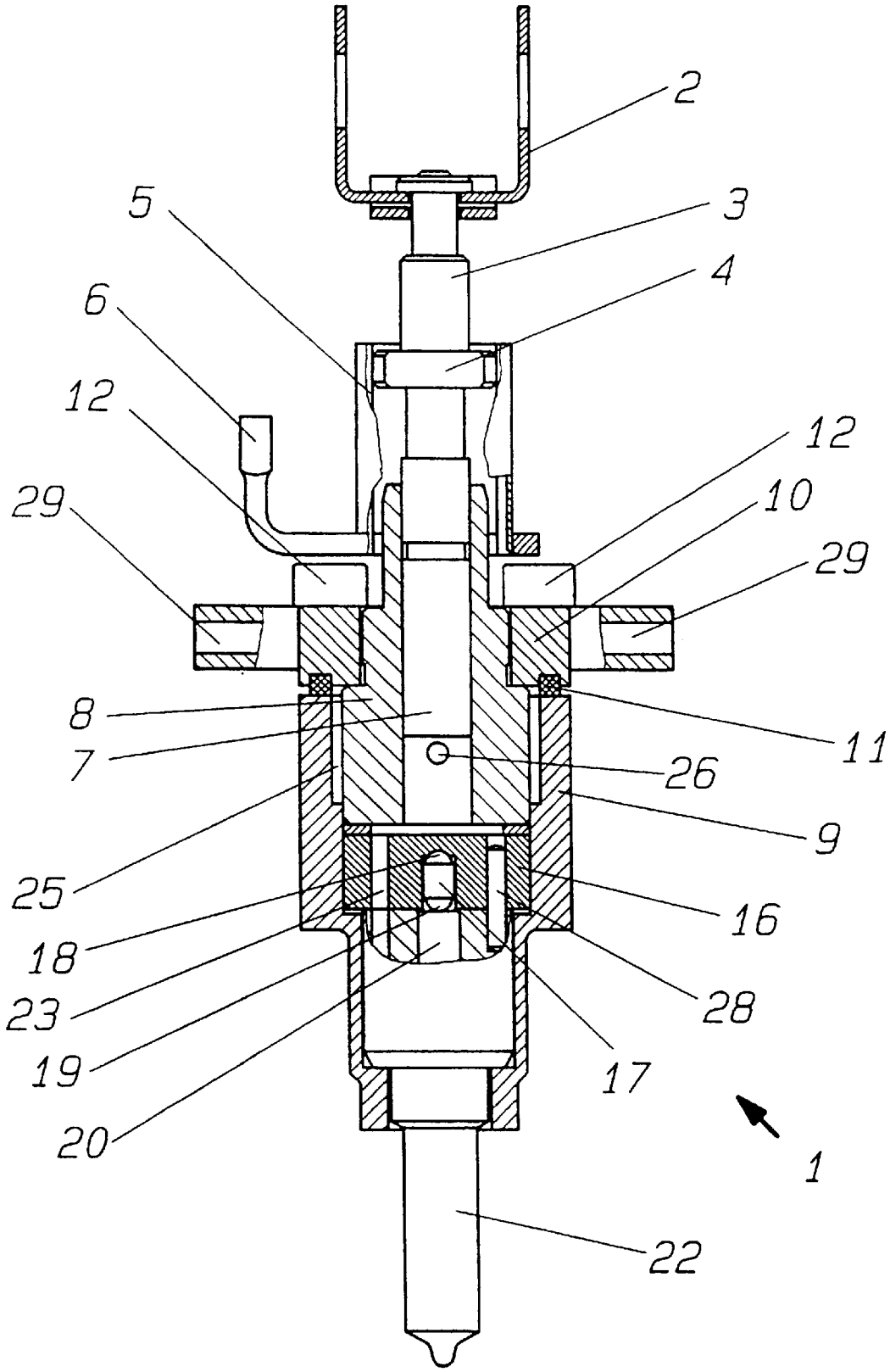
FIG. 2 shows a further section perpendicular to the plane of the section of FIG. 1.

FIG. 2 shows a Further section through the pump nozzle, viewed from the direction of arrow A in FIG. 1. Therein, in addition to the individual parts already illustrated in FIG. 1, there can also be seen a further locating pin 28 for positioning intermediate washer 16 on nozzle body 22 and also the fuel line 29. Fuel line 29 is joined to cover 10 and overlaps compression-spring chamber 13 (see FIG. 3).

Figure 3:
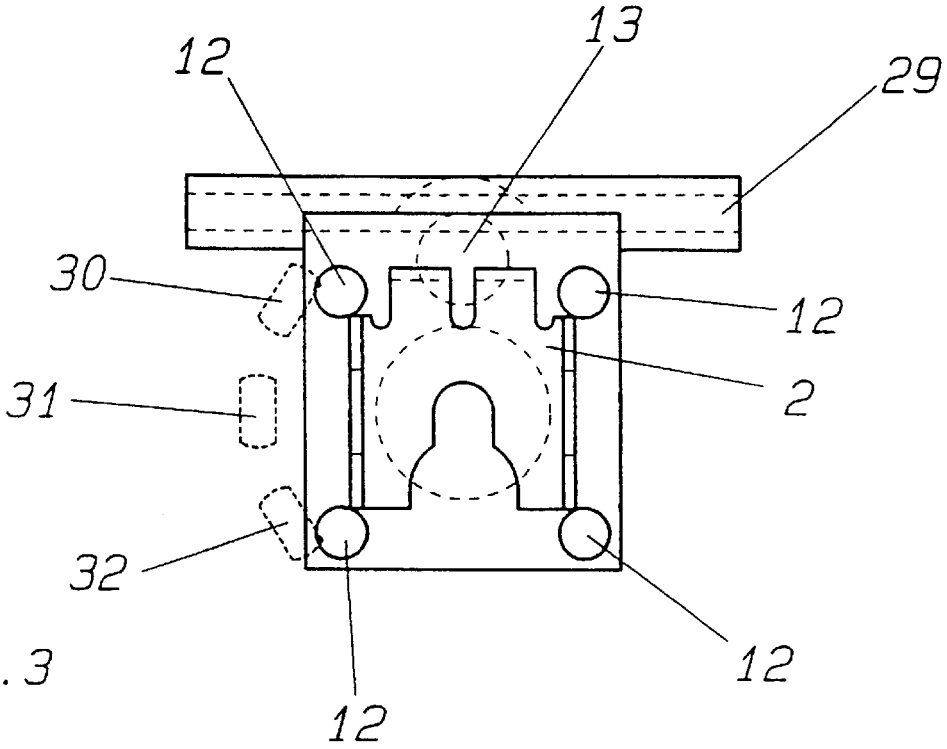
FIG. 3 shows a schematic top view of the pump nozzle of FIG. 1.

FIG. 3 shows a schematic top view of the pump nozzle according to FIG. 1. Three different positions 30, 31 and 32 of the control connecting rod are indicated as broken lines. The geometric configuration of driver 2 is also shown. The overlap between fuel line 29, indicated as a broken line, and compression-spring chamber 13, also indicated as a broken line, is clearly evident.

Figure 4:
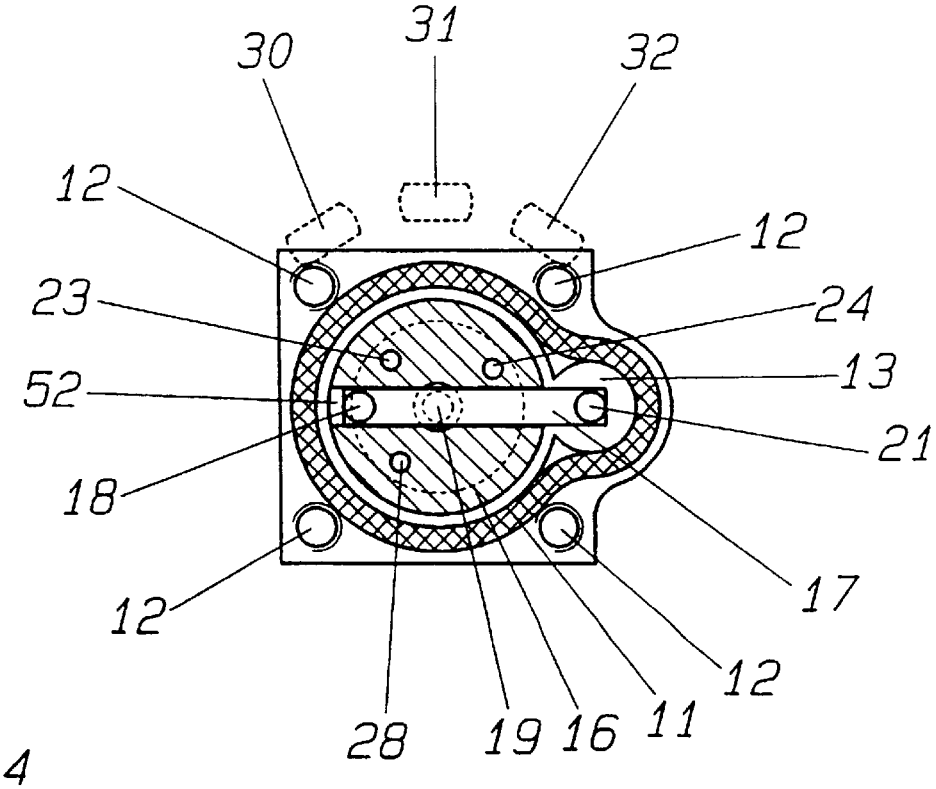
FIG. 4 shows a section along line IV—IV of FIG. 1.

FIG. 4 shows a section along line IV—IV of FIG. 1 with the positions 30, 31 and 32 of the control connecting rod indicated as broken lines. Reversing lever 17 as well as cord packing 11 are also illustrated. The positions of locating pins 24, 28 and of pressure duct 23 in intermediate washer 16 are clearly evident. The route of the section along line IV-IV is a staggered section which runs through cord packing 11 and then downward to intersect intermediate washer 16, but not reversing lever 17 inserted therein. Compression spring 14 and compression-spring plate 15 have been removed for greater clarity.

Under the delivery pressure of the fuel pump, the fuel passes through fuel line 29 into compression-spring chamber 13, which also acts as the suction chamber, and thereby into annular chamber 25, from where it continues through ports 26 and 27 into the interior of pump cylinder 8. By actuation of a driving element such as a cam, piston foot 3 and thus piston pump 7 are displaced axially from bottom dead center toward intermediate plate 16 and thus to top dead center. During this process, piston lug 4 moves axially inside control sleeve 5. As soon as pump piston 7 has completely closed port 26, the pressure in pressure duct 23 rises until it is higher than the spring pressure exerted on the valve needle by reversing lever 17. At this nozzle-opening pressure, the valve needle is lifted from its seat and the fuel emerges in finely atomized form through the uncovered injection ports of the nozzle cone. In the process, spring 14 is further compressed. During the upward movement of pump piston 7, the pressure in pressure duct 23 collapses at the moment at which suction port 26 becomes uncovered by the control edge of pump piston 7, thus allowing fuel to escape through the compression-spring chamber into the fuel line, or in other words when communication is established between the high-pressure and low-pressure zones.

For this purpose, reversing lever 17 is guided in a longitudinal slot. 52, which is disposed in intermediate washer 16. By adjusting control connecting rod 6, piston lug 4 is turned by control sleeve 5 in circumferential direction, whereby the control edge, which is not shown, is simultaneously turned toward suction port 26 for the purpose of changing the injection flow.

What is claimed is:

1. A pump nozzle for injecting fuel into an internal combustion engine, comprising:

a pump house, a pump cylinder disposed in said pump housing and a pump piston disposed in said pump cylinder, a compression spring chamber provided in said pump housing, said compression spring chamber having a compression spring and a compression spring plate disposed therein, an intermediate washer attached to said pump cylinder, a valve needle connected to said intermediate washer, and a reversing lever pivotally connected to said valve needle, said intermediate washer and said spring plate at first, second and third pivot points respectively, said compression spring biasing said valve needle closed through said reversing lever, wherein said compression spring is disposed off to the side of the valve needle axis and beside said pump cylinder.

2. A pump nozzle according to claim 1, wherein the intermediate washer is provided with a longitudinal slot to accommodate the reversing lever.

3. A pump nozzle according to claim 1, wherein the compression spring chamber is constructed as a fuel feed.

4. A pump nozzle for injecting fuel into an internal combustion engine, comprising:

a pump housing, a pump cylinder disposed in said pump housing and a pump piston disposed in said pump cylinder, a compression spring chamber provided in said pump housing, said compression spring chamber having a compression spring and a compression spring plate disposed therein, an intermediate washer attached to said pump cylinder, and a valve needle connected to said intermediate washer and biased closed by said compression spring, wherein said compression spring is disposed off to the side of the valve needle axis and beside said pump cylinder.

* * * * *